United States Patent [19]

Atchisson

[11] 4,128,042

[45] Dec. 5, 1978

[54] AUTOMATIC BOLT CATCH RELEASE APPARATUS FOR FIREARM

[76] Inventor: Maxwell G. Atchisson, 6695 Ridgemoore Dr., Doraville, Ga. 30360

[21] Appl. No.: 818,768

[22] Filed: Jul. 25, 1977

Related U.S. Application Data

[63] Continuation of Ser. No. 645,362, Dec. 30, 1975, Pat. No. 4,057,003.

[51] Int. Cl.[2] ..... F41D 11/00

[52] U.S. Cl. ..... 89/138

[58] Field of Search ..... 89/138

[56] References Cited

U.S. PATENT DOCUMENTS 4,069,608 1/1978 Jurek ..... 42/49 A

*Primary Examiner*—Stephen C. Bentley

*Attorney, Agent, or Firm*—Jones, Thomas & Askew

[57] ABSTRACT

Automatic bolt catch release apparatus for an open-bolt firearm of the type which includes a bolt catch to retain the fully-automatic bolt in open position upon firing the last round in a magazine. The bolt catch is released when the empty magazine is withdrawn from the firearm, so that the bolt can move forward into engagement with the sear to be maintained in a fireable open position. The firearm can then be fired as soon as a fresh magazine is provided.

3 Claims, 4 Drawing Figures

AUTOMATIC BOLT CATCH RELEASE APPARATUS FOR FIREARM

This is a continuation of application of Ser. No. 645,362, filed Dec. 30, 1975, now U.S. Pat. No. 4,057,003, issued Nov. 8, 1977.

This invention relate to improvements in the operation of fully-automatic firearms.

The conventional M16 rifle fires from a closed bolt, meaning that the bolt is closed and locked before the trigger is pulled. Closed bolt firing is undesirable under operating conditions in which the weapon is expected to undergo a substantial amount of full-auto firing. With the bolt always closed, cooling air cannot circulate into the chamber and a live round always remains in the hot chamber after firing. Occasionally a live round in the chamber of a closed-bolt weapon, such as the M16, can "cook off" or explode from the heat in the chamber, after a number of rounds have been fired in rapid succession.

Prior proposals for modifying the M-16 rifle to fire with an open bolt have generally required permanent modifications to the rifle, such as drilling or machining of parts, which is time-consuming and expensive, which must be accomplished in a machine shop facility, and which renders the firearm incapable of re-conversion to standard closed-bolt construction.

Firearms such as the conventional M16 rifle are provided with a bolt catch which retains the bolt in the open position upon firing the last round in a magazine. The bolt is thereafter manually released after a fresh magazine is inserted, so that a round is chambered in readiness for firing. When such rifles are converted or otherwise equipped for open-bolt firing, however, a rifle with a fresh magazine may falsely appear to be fireable at a time when the bolt is actually retained in the non-fireable open position by the bolt catch.

It is an object of the present invention to provide an improved open bolt conversion assembly for a fully-automatic firearm.

It is another object of the present invention to provide an open-bolt automatic firearm with a bolt catch that is automatically released in response to substitution of magazines.

The foregoing and other objects of the present invention will become more readily apparent from the following description of the disclosed embodiments as described with respect to the drawing, in which.

Open Bolt Conversion

Figure 1:
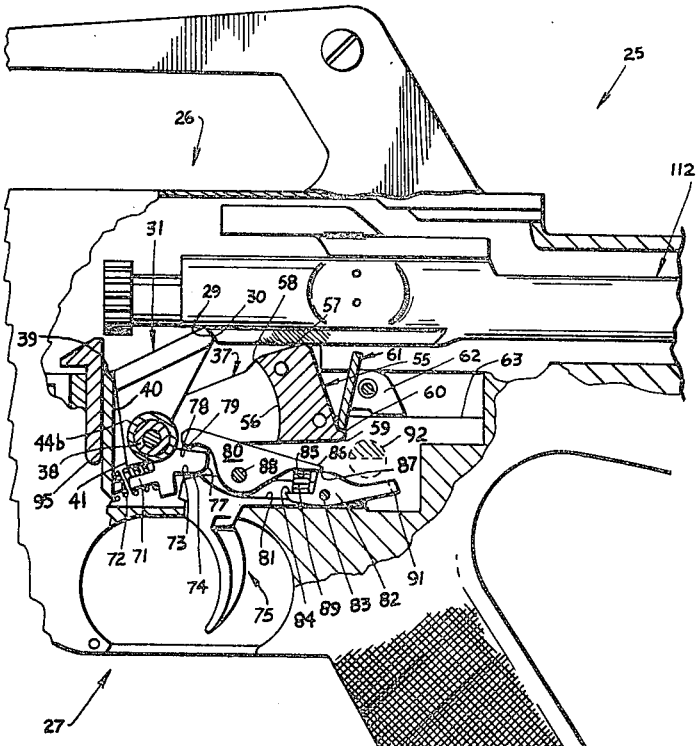
FIG. 1 shows a partially-sectioned side elevation view of an M16 rifle containing the open bolt conversion apparatus of the present invention.
Figure 2:
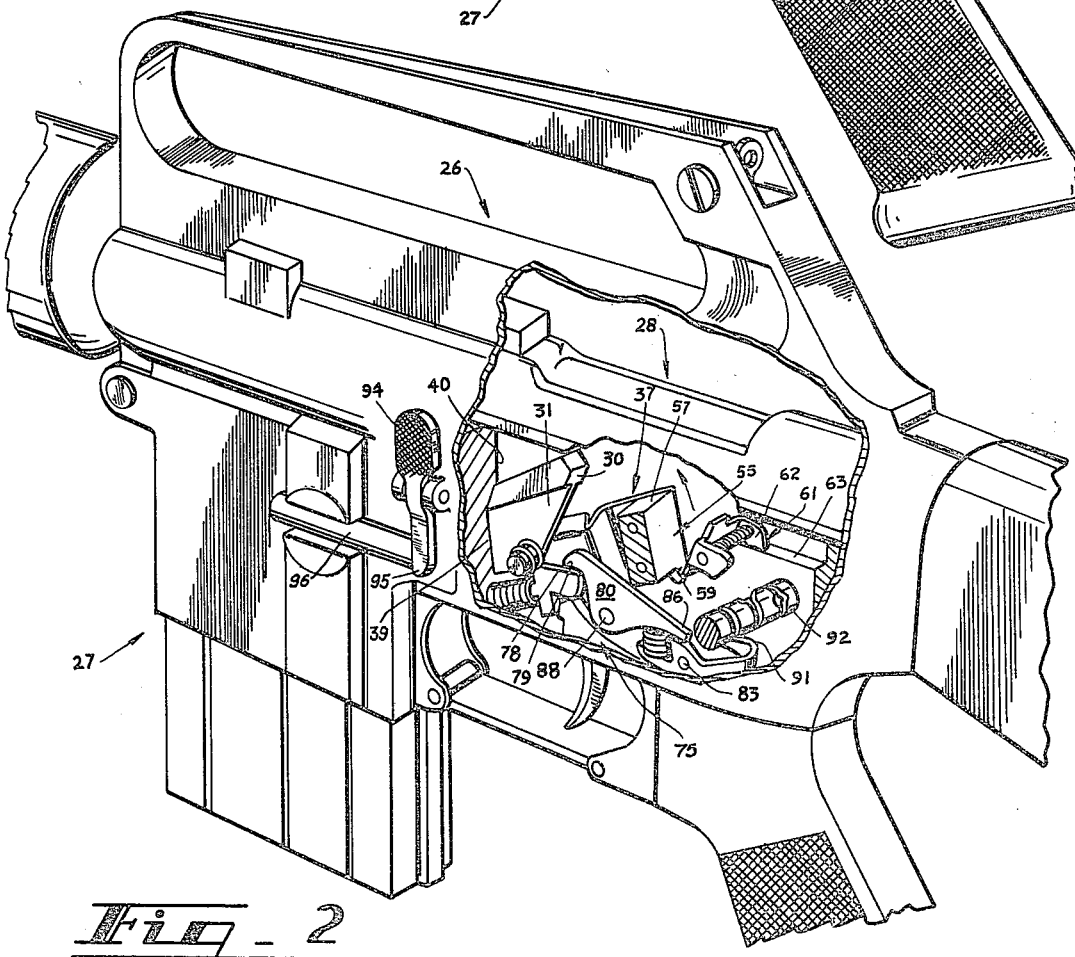
FIG. 2 is a pictorial view, partially broken away and partially sectioned, of the open-bolt firing apparatus of FIG. 1., with the bolt carrier moved forward into firing position.

Turning to the embodiment of open bolt conversion apparatus as shown in FIGS. 1–4, it will be recognized that such apparatus has been installed in an otherwise-conventional M16 rifle indicated generally at 25 and including an upper receiver section 26 and a lower receiver section 27. The bolt carrier 112 may be a conventional M16 bolt carrier with an angular surface 29 provided at the lower front portion of the bolt carrier to provide a contact surface which meets with the surface 30 of the sear 31. The bolt carrier 112 is depicted in the open and cocked position in FIG. 1, with the bolt assembly being urged forwardly to firing position by the conventional coil action spring, and with the aforementioned contact of bolt surface 29 and sear surface 30 preventing the bolt from forward movement.

Figure 3:
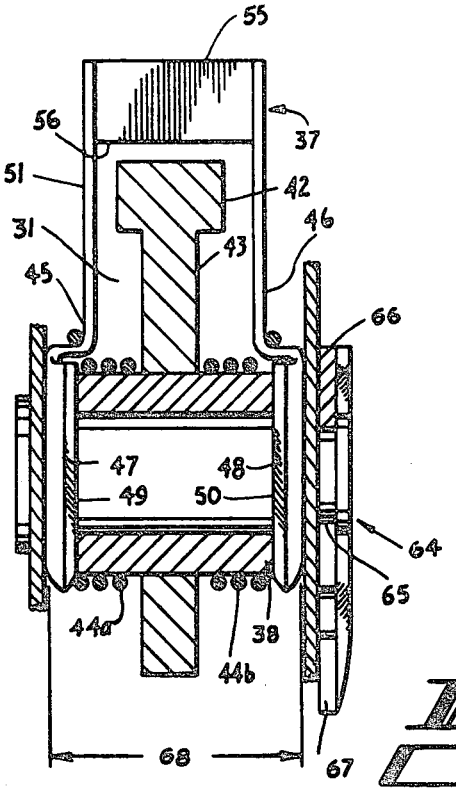
FIG. 3 is an end elevation view of the hammer and sear subassembly contained in the disclosed embodiment of the open bolt conversion.

The sear 31 is mounted concentrically with the hammer 37, with the sear having a hole that mates with the sear-hammer bushing 38. The sear 31 has a flat front surface 39 which rests against the front wall 40 of the lower receiver trigger housing recess, when the bolt carrier 112 is retained in the open position as shown in FIG. 1. A substantial part of the bolt carrier assembly impact against the sear, during sear engagement after recoil, is thus taken by the contact between the sear surface 39 and the receiver wall 40. The angular portion 41 of the sear 31 provides clearance for the sear to rotate during firing, as described below. As best seen in FIG. 3, the sear has a thick upper surface 42 to provide adequate strength for contact by the bolt carrier 112, while the lower portion 43 of the sear is relatively thin to allow room for the left hammer spring 44*a* and the right hammer spring 44*b* which surround the sear-hammer bushing 38 between the legs 45 and 46 of the hammer 37.

The legs 45 and 46 of the hammer may be thin sheet metal stampings and have inner surfaces 47 and 48 which locate against shoulders 49 and 50 of the bushing 38. The upper portion 51 of the hammer 37 is narrow enough to enter the bottom of the standard M16 upper receiver 26, yet wide enough internally to provide clearance for the upper portion 42 of the sear 31. The upper section 51 of the hammer terminates in the hammer block 55 which bridges the open ends of the aforementioned legs 45 and 46 and which may advantageously be fabricated of laminated sheet metal sections. The hammer block 55 has an inner radius 56 which allows clearance for rotation of the sear upper portion 42. The forward surface 57 of the hammer block 55 strikes the rear end of the firing pin (not shown) during firing, and the radius 58 at the inner edge of the forward surface 57 prevents the bolt carrier 112 from hooking the hammer block during cocking. The hammer block has a rearwardly projecting surface 59 which forms a locking hook for the surface 60 of the automatic sear 61, whereby the hammer 37 is retained in the cocked position shown in FIG. 1 until the automatic sear is released by forward movement of the bolt carrier 112 as described below. A stop 62 on the automatic sear 61 rests on ledge 63 that is present on the right side of the lower receiver housing, to limit rearward movement of the automatic sear.

Figure 4:
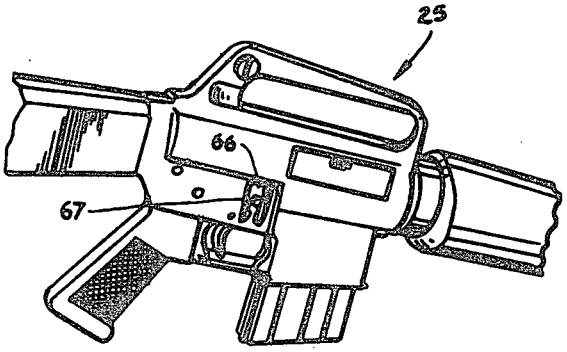
FIG. 4 is a fragmentary pictorial view of an M16 receiver, showing the locking arrangement for the sear/hammer pin.

The sear-hammer bushing 38 has a cylindrical opening through which is received the sear-hammer pin 64. The sear-hammer pin 64 is configured to fit within the existing M16 hammer pin hole (not shown), and the sear-hammer pin has a circumferential slot 65 which extends on the exterior of the lower receiver right side for engagement with the pin retainer 66, as shown in FIG. 4. The pin retainer 66 is preferably made of thin spring steel, and has a pair of legs 67 which are resiliently spreadable to snap over the sear-hammer pin 64 for retention within the slot 65. It will be appreciated that the sear 31, the hammer 37, the sear-hammer bushing 38, and the hammer springs 44*a* and 44*b* provide a subassembly which can be installed or removed in the rifle, in substitution of the conventional M16 hammer. The width 68 of the hammer 37 locates against the inside walls of the lower receiver trigger housing recess.

The sear 31 includes a projection 71 located below the sear-hammer bushing 38, and best seen in FIG. 1, which retains the sear spring 72. The sear 31 has a surface 73 located immediately above the mating surface 74 of the trigger 75, so that the sear can be locked against firing movement when the trigger is locked by application of the safety, as described below. The radius 77 of the sear 31 prevents jamming of the sear and the trigger surface 74 during firing, yet permits engagement of the sear with the trigger to prevent the sear from dropping below the trigger and becoming permanently jammed out of engagement.

The sear 31 has a firing contact surface 78 located behind the sear axis of rotation about the sear-hammer bushing 38, and the firing contact surface 78 is contacted by the curved forward portion 79 of the connector 80.

The connector 80 is retained within the slot 81 of the trigger 75 by the pin 88, which allows the connector to rock back and forth within the slot. Also mounted within the slot 81, at a position rearwardly of the connector 80, is the disconnector 82 which is mounted for rocking motion by the pin 83. The disconnector 82 has a lower forward surface 84 in underlying spaced-apart relation with the rearward underlying surface 85 of the connector 80, and the connector-disconnector spring 86 is positioned between the surfaces 84 and 85 to urge the connector 80 and the disconnector 82 in opposition to each other. The connector 80 has a rearwardly-extending surface 86 which contacts the upper surface 87 of the disconnector 82.

Extending from the rear of the disconnector 82 is the selector engaging member 91 which somewhat resembles the shape of a scorpion tail, and which is disposed beneath the shank of a conventional M16 firing selector lever 92, so that the selector engaging member 91 engages the selector lever 92 when the latter is set on semi-auto, and so that the selector engaging member 91 enters the automatic sear recess of the selector lever when set on full-auto.

The bolt carrier of a conventional closed-bolt M16 rifle is retained in the open position upon firing the last round in a magazine, and the bolt carrier is released by manually operating the bolt catch 94 after a fresh magazine is inserted into the lower receiver. Since the bolt carrier 112 of the present open bolt conversion is always retained in the open or rearward position, however, the open bolt rifle may appear to be ready to fire even while the bolt carrier is engaged by the bolt catch. This problem is overcome by providing an automatic bolt catch extension 95 which overlies the conventional magazine catch 96. The magazine catch 96 is moved outwardly when the magazine catch button (not shown) on the right side of the firearm is depressed, and the magazine catch contacts the automatic bolt catch extension 95 to operate the bolt catch 94 and thereby to release the bolt carrier 112. The bolt carrier 112 is now released to move forwardly a short distance until the bolt carrier surface 29 contacts the sear surface 30, whereupon the bolt assembly is ready for firing upon insertion of a fresh magazine.

The open bolt conversion as described with respect to the foregoing embodiment functions as follows. The bolt carrier is pulled backward in the conventional manner, and the bolt carrier pushes the hammer 37 to the cocked position in which the surface 59 of the hammer is engaged by the surface 60 of the automatic sear 61. The sear spring 72 moves the sear 31 upwardly, and the sear surface 30 engages the forward surface 29 on the underside of the bolt carrier 112, holding the bolt carrier at the cocked position shown in FIG. 1. If the selector lever 92 is set on "safe" at this time, the trigger 75 is locked in the normal M16 manner; such trigger locking also locks the surface 73 of the trigger beneath the surface 74 of the sear, thereby providing a double lock against firing while on safe.

Setting the selector lever 92 to the conventional full-auto position allows the trigger 75 to be depressed. The selector engaging member 91 of the disconnector 82 is carried upwardly within the automatic sear recess of the selector lever, and the surface 87 of the disconnector remains in contact with the surface 86 of the connector 80, so that the connector pivots about the trigger pin 88 along with the trigger 75. The forward portion 79 of the connector depresses the firing contact surface 78 of the sear 31, lowering the sear surface 30 from the surface 29 of the bolt carrier 112 and allowing the bolt carrier to move forward. The bolt carrier feeds a round from the magazine into the chamber, and the bolt locks in the conventional manner. Final forward movement of the bolt carrier 112 causes the forward surface 122 of the automatic sear release 113 (or a fixed projection on the bolt carrier of an M16 which lacks the present cyclic rate reducer apparatus) to engage and trip the automatic sear 61 to be tripped by structure such as the fixed projection on the conventional bolt carrier of an M16, allowing the hammer 37 to move up and forward under pressure of the hammer springs 44*a* and 44*b*, so that the hammer strikes the firing pin and the weapon fires in the normal manner. Recoil movement of the bolt carrier 112 again cocks the hammer 37, and the firing cycle is repeated as long as the trigger is held depressed. Releasing the trigger allows the sear spring 72 to raise the sear 31 to the upright position shown in FIG. 1, to stop the bolt carrier. The sear spring 72 also returns the trigger 75, through the connector 80 and disconnector 82, to the forward position.

When the selector lever 92 is set at semi-auto firing position, it will be recalled that the selector engaging member 91 of the disconnector 82 is moved upwardly into engagement with the selector lever when the trigger 75 is pulled rearwardly. The rear of the disconnector 92 is thereby depressed and the disconnector pivots about the pin 83, causing the surface 87 of the disconnector to move out from under the overhanging surface 86 of the connector 80 as the sear 31 is moved downwardly to release the bolt assembly 28 for its forward movement. The sear spring 72 is much more powerful than the connector-disconnector spring 89, so that the sear 31 moves up when permitted by movement of the bolt assembly, while rocking the connector 80 rearwardly about the trigger pin 88 and compressing the connector-disconnector spring 89. The sear surface 81 is thus returned into position to engage the surface 29 of the bolt assembly after the bolt assembly moves rearwardly upon recoil, so that only a single round is fired. When the trigger is released, the connector-disconnector spring 89 returns the trigger to forward position so that the disconnector 82 is lowered and the disconnector surface 87 reengages the surface 86 of the connector. The weapon is again ready to fire when the trigger is pulled.

It will be understood that the foregoing relates only to a preferred embodiment of the present invention, and that numerous modifications and alternative embodiments may be provided without departing from the spirit and the scope of the invention as defined in the following claims.

I claim:

1. Bolt catch automatic release apparatus for an M16 firearm which has been converted to fire with an open bolt, and which includes a receiver housing, a reciprocating bolt mechanism mounted within said receiver housing, and a hammer-operated firing pin carried by said bolt mechanism, comprising;

sear means disposed within said receiver housing and selectably operative to engage and retain said bolt mechanism in a fireable open position;

trigger means operatively associated with said sear means to move said sear means so that said bolt mechanism moves forward from said fireable open position to a closed firing position to fire a round;

a bolt catch which retains said bolt mechanism in a non-fireable open position independently of said sear means in response to firing the last round in a magazine;

magazine release means operative to release a magazine from said firearm; and means operative in response to operation of said magazine release means to release said bolt catch so that said bolt mechanism can move forward from said non-fireable open position into engagement with said sear means for retention in said fireable open position by said sear means, so that said converted open-bolt firearm is in fireable condition when a fresh magazine is substituted for the released magazine.

2. Apparatus as in claim 1, wherein said bolt catch release means comprises means which forms an extension of said bolt catch means and which overlies said magazine release means to be actuated by said magazine release means, when said magazine release means is operated to release a magazine from said firearm.

3. Bolt catch automatic release mechanism for a firearm which fires with an open bolt, and which includes a receiver housing and a reciprocating bolt means mounted within said receiver housing, comprising;

means disposed within said receiver housing and selectably operative to engage and retain said bolt means in a fireable open position;

trigger means operative to release said bolt engaging means so that said bolt means can move forward from said fireable open position to a closed firing position to fire a round;

a bolt catch which retains said bolt means in a non-fireable open position independently of said bolt engaging means in response to firing the last round in a magazine;

means operative to release a magazine from said firearm; and means operative in response to operation of said magazine release means to release said bolt catch so that said bolt means can move forward from said non-fireable open position into engagement with said bolt engaging means for retention in said fireable open position by said bolt engaging means, so that said firearm is automatically placed in fireable condition when a fresh magazine is substituted for the released magazine.

* * * * *